US005377273A

United States Patent [19]

Sutton

[11] Patent Number: 5,377,273

[45] Date of Patent: Dec. 27, 1994

[54] BATTERYLESS POWER SUPPLY FOR TRANSDUCERS

[75] Inventor: Christopher K. Sutton, Everett, Wash.

[73] Assignee: Hewlett-Packard Company, Palo Alto, Calif.

[21] Appl. No.: 857,859

[22] Filed: Mar. 26, 1992

[51] Int. Cl.[5] ..... H04R 3/00

[52] U.S. Cl. ..... 381/122; 381/111

[58] Field of Search ..... 381/122, 113, 114, 111

[56] References Cited

U.S. PATENT DOCUMENTS

| | | | |
|---|---|---|---|
| 3,305,638 | 2/1967 | Teachout | 381/113 |
| 3,660,602 | 5/1972 | Thompson | 381/114 |
| 3,961,202 | 6/1976 | Kono et al. | 381/113 |
| 4,280,018 | 7/1981 | Lazarus et al. | 381/114 |
| 4,541,112 | 9/1985 | Kern | 381/122 |
| 4,888,807 | 12/1989 | Reichel | 381/113 |
| 5,122,970 | 6/1992 | Gilbert et al. | 364/506 |

OTHER PUBLICATIONS

Hewlett Packard, *Physical Sensors Catalog*, 1990.

Wilcoxon Research, *720 Series Accelerometers*, Product Data.

Brüel & Kjaer, *Battery Driven Power Supply Type 2804*, Instruction Manual, Sections 1, 2 and 3.

PCB Piezotronics, Inc., *Quartz Sensors*, Excerpts from catalog, pp. 2, 68, 139.

*Primary Examiner*—Curtis Kuntz

*Assistant Examiner*—Ping W. Lee

[57] ABSTRACT

A microphone power supply for use with precision microphones having an attached pre-amplifier, connects to an analyzer with a coaxial cable and is powered by an ICP current source in the analyzer. The power supply provides a polarization voltage and a pre-amplifier power voltage to a microphone and pre-amplifier assembly. The power supply receives an AC audio signal produced by the microphone, buffers the AC signal, and provides the AC signal to the analyzer through the coaxial cable.

14 Claims, 3 Drawing Sheets

BATTERYLESS POWER SUPPLY FOR TRANSDUCERS

FIELD OF THE INVENTION

The present invention relates to a power supply for providing power from an integrated circuit piezoelectric (ICP) source to precision microphones and other transducers having built in pre-amplifiers.

BACKGROUND AND SUMMARY OF THE INVENTION

Unlike microphones used in commonplace sound recording, precision measurement microphones have an attached pre-amplifier. Direct attachment of the pre-amplifier to the microphone avoids the effects of cable capacitance and noise. However, when combined with the pre-amplifier, precision microphones require a plurality of voltages. Typically, two voltages are required, a +200 volts DC polarization voltage at almost no current and a +28 volts DC pre-amplifier power voltage at 1 mA. Because of the multiple voltage requirement, precision microphones typically require their own power supply capable delivering the required voltages.

Measurements with a precision microphone, therefore, often require three pieces of equipment: (1) a precision microphone with a built-in pre-amplifier; (2) a power supply for the microphone; and (3) an analyzer. The two voltages required by the microphone for operation are provided by the power supply. The precision microphone is also connected to the analyzer via a coaxial cable. The analyzer performs measurements on an AC audio signal produced by the microphone.

For portable precision microphone measurements, the power supply and the analyzer are usually each supplied with a battery as a power source. This is because, in general, analyzers are not constructed to allow connection of the microphone power supply directly to the battery which powers the analyzer. However, separate battery power sources for the analyzer and microphone power supply are inconvenient because of the added bulk and weight of having a separate battery for each. Also, the analyzer and microphone power supply must each be switched off to avoid running down their battery supplies. Unfortunately, it is easy to overlook switching off both the analyzer and the microphone power supply, resulting in a lack of power when needed.

Many analyzers provide a constant current source which is intended to power ICP accelerometers. These current sources permit operation of the analyzer with an ICP accelerometer as a two-wire (coaxial) system. A first wire connecting the analyzer and accelerometer is a ground wire. A second wire is a signal and power wire which conducts a constant current of 4 mA from the constant current source in the analyzer to the ICP accelerometer. The signal/power wire also conducts an AC signal produced by the accelerometer to the analyzer for analysis. ICP accelerometers do not require multiple power voltages. Therefore, a power supply is not required for ICP accelerometer applications.

The present invention provides a power supply for precision microphones and other transducers that does not require a separate battery source. The power supply according to the present invention makes use of the constant current source described above to produce the power supply voltages required by a precision microphone. Thus, the microphone power supply does not require its own separate battery power source. The analyzer's battery or AC power source provides power to both the analyzer and to the microphone power supply, the latter being supplied through the analyzer's ICP constant current source.

One advantage to the present invention is that only a two-wire connection is required between the microphone power supply and the analyzer containing the battery power source for transmission of both power and AC measurement signals. A coaxial cable can therefore be used to connect the microphone power supply and analyzer. One wire is used to conduct a constant current from the analyzer ICP current source to the power supply and to conduct an AC signal from the microphone to the analyzer. The second wire is used as a ground wire.

An additional feature of the microphone power supply is to buffer the AC measurement signal produced by the microphone. A buffer amplifier is therefore provided in the microphone power supply. The buffer amplifier is also powered by voltages produced from the constant current received from the ICP current source.

Additional features and advantages of the invention will be made apparent from the following description of the preferred embodiment, which proceeds with reference to the accompanying drawings.

DETAILED DESCRIPTION OF THE PREFERRED EMBODIMENT

Figure 1:
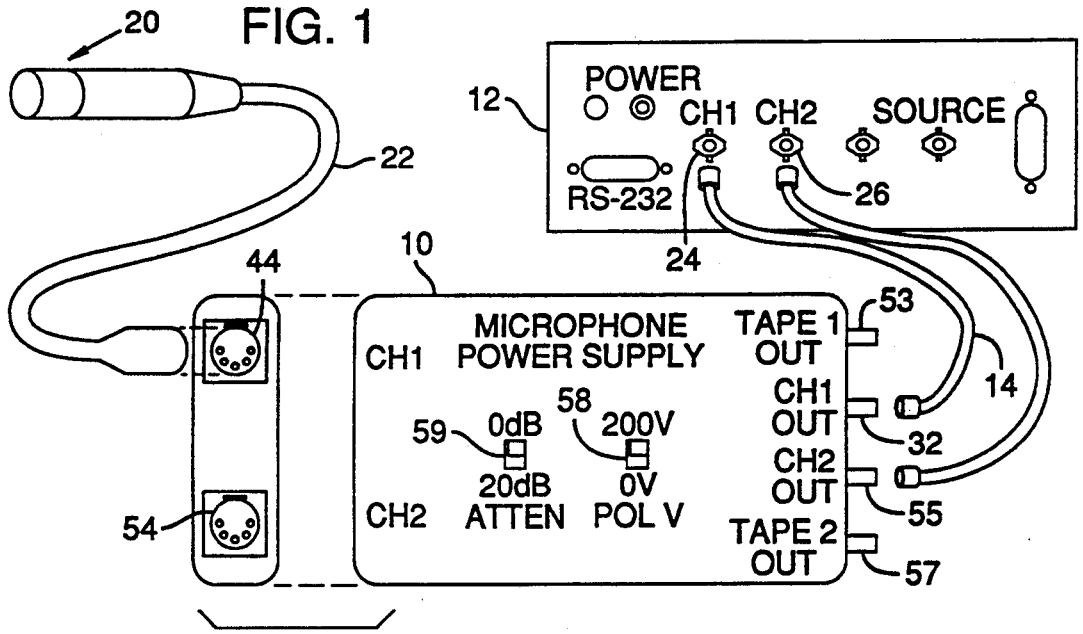
FIG. 1 is a plan view of a microphone power supply according to a preferred embodiment of the present invention.
Figure 2:
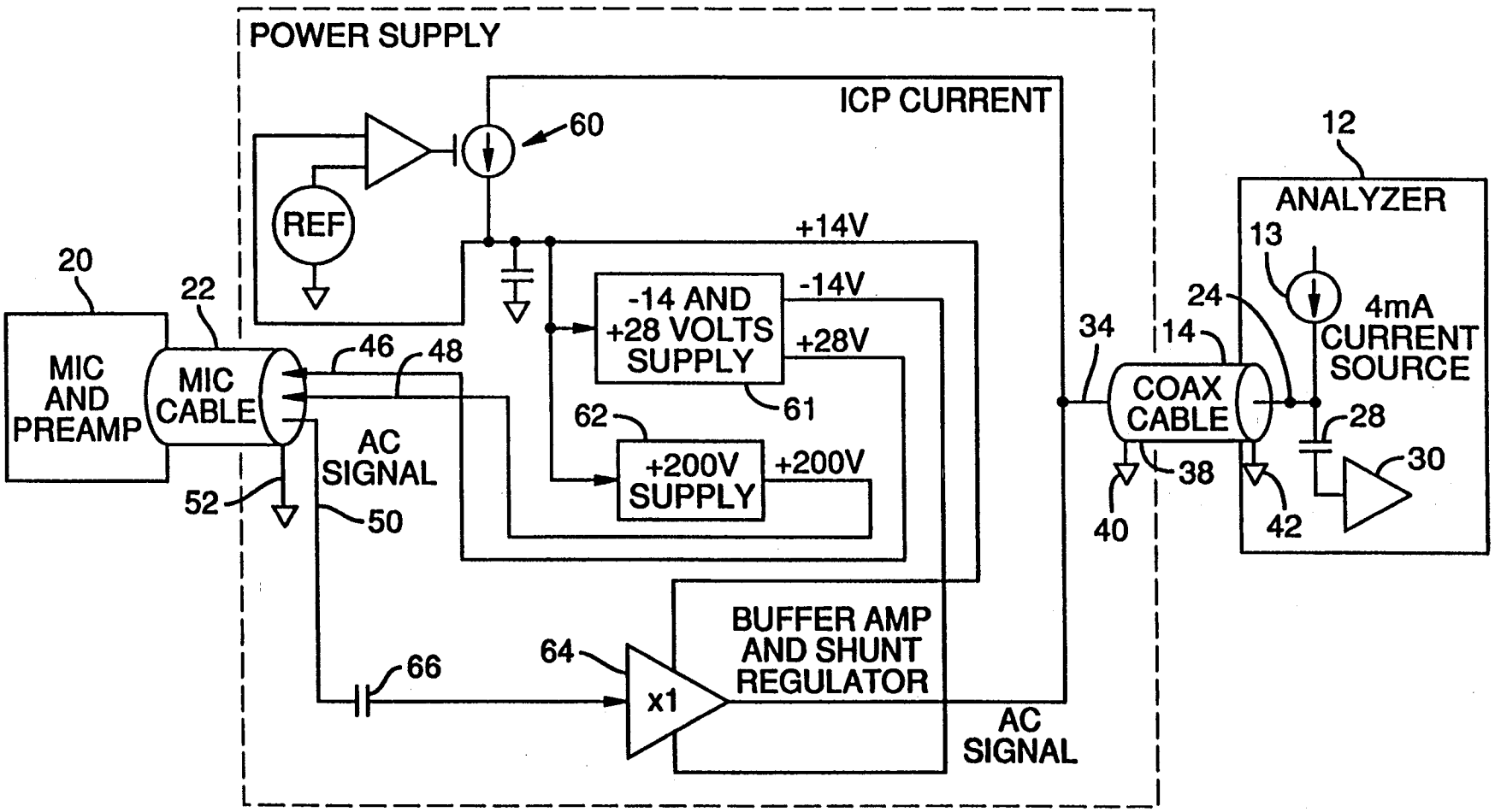
FIG. 2 is a block diagram of a power supply circuit in the microphone power supply of FIG. 1.

Referring to FIGS. 1 and 2, a microphone power supply 10 according to a preferred embodiment of the present invention comprises a power supply circuit housed in an electrically shielded box 11. The box 11 may be constructed of plastic or metal and has the following approximate dimensions: length, 4 to 6 inches; width, 4 inches; and height, 1.1 inches. The power supply 10 can be connected to an analyzer 12 having a constant current source 13 using a two-wire cable 14. The analyzer 12 can be any device for measuring or recording sound, including a spectrum analyzer, sound level meter, real time octave analyzer, or tape recorder. The following Hewlett Packard (HP) spectrum analyzers contain ICP constant current sources and perform suitably as analyzer 12: the HP 3560A, the HP 3561A, the HP 3566A, the HP 3567A, and the HP 35665A. The power supply 10 is also connectable to a precision microphone and pre-amplifier assembly 20 (or other transducer) with a microphone cable 22. The HP 35224 pre-amplifier and one of the following HP microphones are suitable for use as the precision microphone and pre-amplifier assembly 20: the HP 35222A, the HP 35221A, and the HP 35223A.

The analyzer 12 used with the power supply 10 includes a channel input 24 which is driven with a 4 mA current by the constant current source 13 in the analyzer 12. The analyzer 12 may also include a second channel input 26. Typically, the channel inputs 24 and 26 are BNC connectors adapted for attachment of one end of a coaxial cable. The channel input 24 is also connected to a coupling capacitor 28 and an amplifier 30 in the analyzer 12. The coupling capacitor 28 passes only AC signals and is used to separate an AC measurement signal received at the channel input 24 for analysis and display by the analyzer 12.

A BNC connector 32 is also provided on the microphone power supply 10 to allow attachment of a coaxial cable. Thus, a coaxial cable may be used as the two-wire cable 14 for connecting the power supply 10 to the channel input 24 of the analyzer 12. A first wire 34 of the two-wire cable 14 serves a dual purpose. The first wire 34 conducts the 4 mA current from the constant current source 13 to the power supply 10, and also conducts the AC measurement signal from the power supply 10 to the analyzer 12. A second wire 38 connects a ground terminal 40 of the BNC connector 32 to a ground 42 of the channel input 24.

The microphone power supply 10 is also provided with a connector 44 for attachment of the microphone cable 22. In the preferred embodiment, a standard 7-pin LEMO connector is used. Four wires in the microphone cable 22 which connects the power supply 10 to the precision microphone and pre-amplifier assembly 20 are used to conduct electrical signals. A first wire 46 is driven by the power supply 10 with a +28 volts DC pre-amplifier power voltage. The power supply drives a second wire 48 with a +200 volts DC polarization voltage. The AC measurement signal originates in the microphone and is conducted by a third wire 50 to the power supply 10. A fourth wire 52 is a ground wire.

In the preferred embodiment of the invention, the microphone power supply 10 has two channels. Dual channel capability is useful in many applications, such as for intensity measurements. Each channel serves to connect a single microphone and pre-amplifier assembly to a single channel input of an analyzer. A first channel of the power supply 10 includes the connector 44 for connection to the microphone and pre-amplifier assembly 20 and the connector 32 for connection to the channel input 24 of the analyzer 12. The first channel also includes a second BNC connector 53 which is an output for a tape recorder. The tape output connector 53 provides a second output for the AC measurement signal to permit simultaneous recording of the signal by a tape recorder and measurement of the signal by the analyzer 12. A second channel of the microphone power supply 10 includes a second LEMO connector 54 for connecting a second microphone and pre-amplifier assembly, a third BNC connector 55 for connecting to a second channel input 56 of the analyzer 12, and a fourth BNC connector 57 for connecting a second tape recorder. The second channel conducts a second AC measurement signal originating in the second microphone and pre-amplifier assembly to the second channel input 56 and to the second tape recorder.

Two slide switches, a polarization voltage switch 58 and an attenuation switch 59 are provided on a top face of the box 11. The switches 58 and 59 are recessed slightly to avoid accidental switching. The polarization voltage switch 58 allows selection of a polarity voltage provided to the microphone and pre-amplifier amplifier assembly 20 by the power supply 10. With the polarization voltage switch 58 in a first position, the power supply 10 is operative to provide a +200 volt DC polarity voltage. With the polarization voltage switch 58 in a second position, the power supply 10 operates to provide a +0 volt DC polarity voltage. With the attenuation switch 59, it is possible to select between 0 dB and 20 dB attenuation of the AC measurement signal by the power supply 10.

With reference to FIG. 2, housed in the box 11, the microphone power supply 10 includes the following circuits for each of the two channels: a +14 volt power supply 60, a −14 volt and +28 volt power supply 61, a +200 volt power supply 62, and a buffer amplifier and shunt regulator 64. The purpose of the power supplies 60–62 is to generate the +200 volt and +28 volt DC voltages required by the microphone and pre-amplifier assembly 20. The power supplies 60 and 61 also generate +14 volt and −14 volt DC voltages for the buffer amplifier and shunt regulator 64. The buffer amplifier and shunt regulator 64 serve to buffer the AC measurement signal received from the microphone and pre-amplifier assembly 20 and also regulate the DC level of the AC measurement signal as it is delivered to the analyzer 12. The various power supplies 60–62 are shown in more detail in the schematic diagram of FIG. 3.

Referring to FIG. 2, a capacitor 66 provides AC coupling of the AC measurement signal from the microphone and pre-amplifier assembly to the buffer amplifier and shunt regulator 64. The buffer amplifier and shunt regulator 64 perform two functions: buffering of the AC measurement signal, and regulating the DC level of the AC measurement signal. Buffering of the AC measurement signal prevents degradation of the signal from nonlinearities in the impedance of the +14 volt power supply 60 and the constant current source 13. The buffer amplifier and shunt regulator 64 have a gain of +1. Regulation of the DC level of the AC measurement signal keeps the DC voltage of the signal in the operating range of the +14 volt power supply 60 and the constant current source 13. The buffer amplifier and shunt regulator 64 regulate the AC measurement signal so that the voltage at the output of the buffer amplifier varies between +15 volts and +21 volts. This output voltage is coupled to the channel input 24 of the analyzer 12. However, the same line is also used to conduct current from the constant current source 13. The +14 volt power supply 60 performs the function of converting the current from the analyzer to a regulated +14 volt DC voltage despite the variable output voltage. The buffer amplifier and shunt regulator are described in greater detail below.

Figure 3:
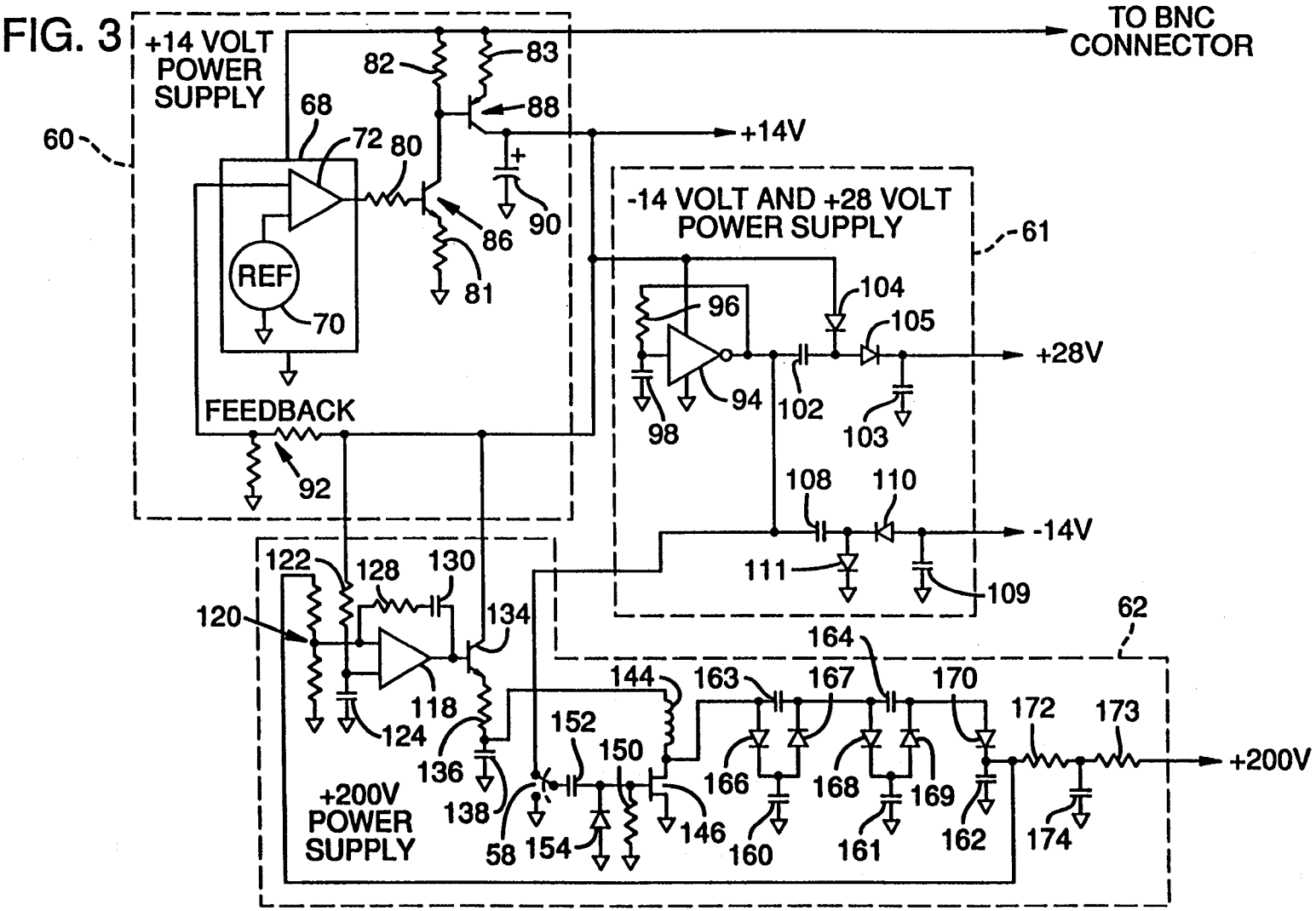
FIG. 3 is a schematic diagram of a portion of the power supply circuit of FIG. 2.

With reference to FIG. 3, the +14 volt power supply 60 includes an integrated circuit 68. The integrated circuit 68 contains a 200 mV reference voltage source 70 and a differential amplifier 72. The differential amplifier 72 compares the voltage produced by the reference voltage source 70 to a feedback voltage and generates an error signal proportional to the difference between the two voltages. The error signal from the differential amplifier 72 drives a voltage controlled current source formed by four resistors 80–83 and two transistors 86, 88. The output of the voltage controlled current source is filtered by a capacitor 90 to produce the +14 volt DC voltage. The +14 volt DC voltage is used to power the power supply 61 and the buffer amplifier 64. A voltage divider 92 divides the +14 volt DC voltage to approximately +200 mV to form the feedback voltage. The feedback control loop provided by the voltage divider and differential amplifier serve to regulate the +14 volt DC voltage.

The power supply 61 converts the +14 volt DC voltage from power supply 60 into two other voltages, −14 volt and +28 volt DC voltages. The −14 volt DC voltage is supplied to the buffer amplifier, while the +28 volt DC voltage is the +28 volt pre-amplifier power voltage provided to the microphone and pre-amplifier assembly 20 on the wire 46. The power supply 61 includes an astable multivibrator 94 which produces a 25 kHz rectangular waveform signal varying between 0 and +14 volts. A resistor 96 and a capacitor 98 set the frequency of the astable multivibrator. The power supply 61 also includes a charge pump voltage doubler circuit and a charge pump voltage inverter circuit. The charge pump voltage doubler circuit is formed by two capacitors 102, 103 and two diodes 104, 105 and operates to double the rectangular waveform signal to produce the +28 volt DC voltage. The charge pump voltage inverter circuit is formed from two capacitors 108, 109 and two diodes 110, 111. The charge pump voltage inverter circuit produces the −14 volt DC voltage.

The power supply 62 generates a regulated +200 volt DC voltage which is used as the polarization voltage for driving the microphone and pre-amplifier assembly 20. The power supply 62 includes a differential amplifier 118 for regulating the +200 volt DC voltage. The differential amplifier compares a feedback voltage to the regulated +14 volt DC voltage produced by the power supply 60. A voltage divider 120 produces the feedback voltage by dividing the output of the power supply 62 to approximately +14 volts. The regulated +14 volt DC voltage from the power supply 60 is coupled to the differential amplifier 118 through a low pass filter formed from a resistor 122 and a capacitor 124 to reduce noise. Frequency compensation of the differential amplifier is provided by a resistor 128 and a capacitor 130. A transistor 134, a resistor 136, and a capacitor 138 form a low pass filter and isolation circuit for coupling the output of the differential amplifier 118 to a flyback circuit described below. The isolation circuit prevents switching noise from the flyback circuit from coupling to the +14 volt power supply 60.

The power supply 62 further includes an inductor 144 and a transistor 146 which form the flyback circuit. The transistor 146 is driven with the 25 kHz rectangular waveform signal produced by the astable multivibrator 94. The transistor 146 is used as a switch to alternately, momentarily connect the inductor 144 to ground, and then disconnect the inductor 144 from ground. Thus, when the transistor 146 is on, current through the inductor 144 increases. When the transistor is turned off, this current generates a +70 volt pulse. The transistor is repeatedly turned on and off by the 25 kHz rectangular waveform to generate a series of +70 volt pulses. The 25 kHz rectangular waveform is coupled to the transistor 146 through a high pass filter comprising a resistor 150, a capacitor 152, and a diode 154. The previously described polarization voltage switch 58 is provided as a means of disabling the +200 volt power supply 62. The polarization switch 58 connects the transistor 146 and associated high pass filter to either the 25 kHz rectangular waveform signal or to ground. When the polarization switch is connected to the 25 kHz rectangular waveform, the +200 volt power supply 62 provides a +200 volt DC voltage. When the polarization switch is connected to ground, the +200 volt power supply is disabled and provides a +0 volt DC voltage.

The series of +70 volt pulses generated by the inductor 144 and the transistor 146 drive a voltage tripler circuit comprising five capacitors 160–164 and five diodes 166–170. The voltage tripler circuit converts the +70 volt pulses into the +200 volt DC voltage. Two resistors 172, 173 and a capacitor 174 form a low pass filter to reduce noise on the +200 volt DC voltage.

Figure 4:
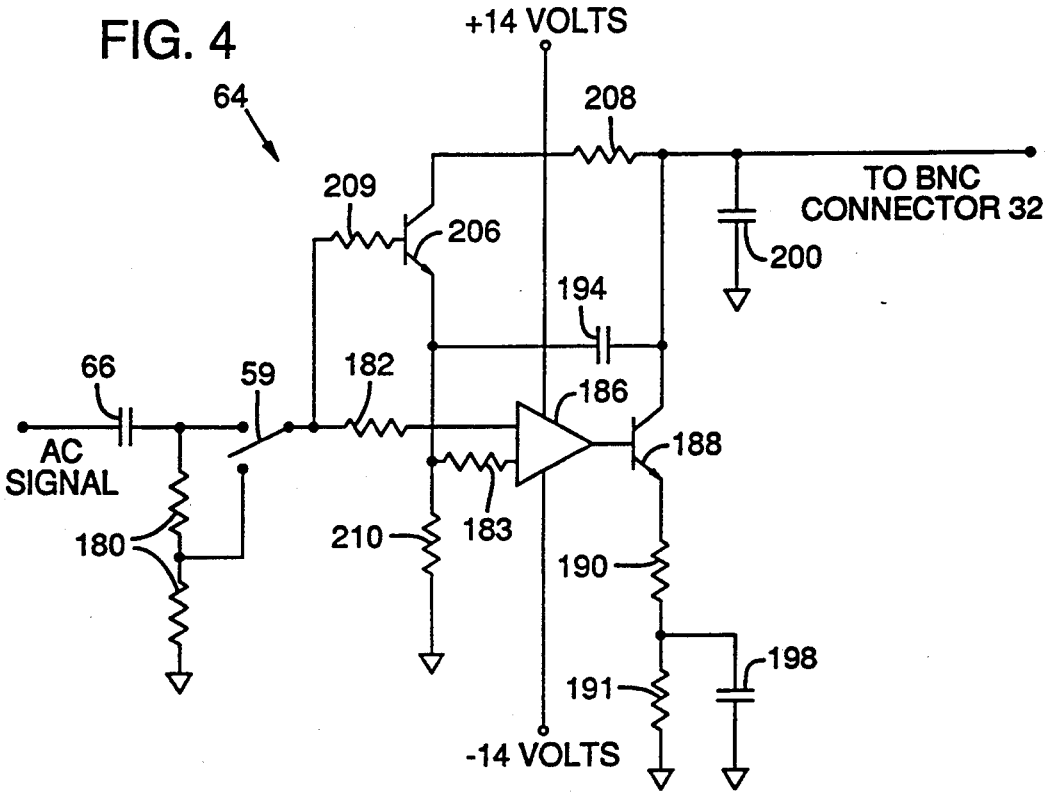
FIG. 4 is a schematic diagram of a further portion of the power supply circuit of FIG. 2.

Referring to FIG. 4, the AC measurement signal from the microphone and pre-amplifier assembly 20 is AC coupled to the buffer amplifier and shunt regulator 64 through the capacitor 66 and an attenuator. The attenuator comprises a voltage divider 180 and the switch 59. The switch 59 has two positions. In a first position, the switch connects the AC measurement signal directly to the buffer amplifier with no attenuation. In its second position, the AC measurement signal is connected through the voltage divider 180 to the buffer amplifier, attenuating the AC measurement signal by 20 dB. Resistors 182, 183 protect the circuit from excessive voltage.

The buffer amplifier and shunt regulator 64 include a class A amplifier stage for buffering the AC measurement signal, comprising an operational amplifier 186, a transistor 188, and two resistors 190, 191. The constant current source 13 in the analyzer 12 is used as an active pull-up. The gain of the amplifier stage is set at +1 by a feedback capacitor 194. Capacitors 198 and 200 provide frequency compensation to the amplifier stage. A transistor 206 and resistors 208–210 form a DC feedback circuit which regulates the DC level of the amplifier stage's output. Thus, the amplifier stage also operates as a shunt regulator which maintains the amplifier stage's output voltage in the operational range of the +14 volt power supply 60.

Allowed U.S. patent application Ser. No. 07/208,352, filed Jun. 17, 1988, relates to ICP transducers and is incorporated herein by reference.

Having described and illustrated the principles of my invention in a preferred embodiment, it should be apparent to those skilled in the art that the invention can be modified in arrangement and detail without departing from such principles. Accordingly, I claim as my invention all such modifications as may come within the spirit and scope of the following claims and equivalents thereto.

I claim:

1. A power supply for transducers comprising:

a signal input for receiving an AC measurement signal from a transducer;

a signal output for receiving a current from a constant current source external to the power supply and for presenting the AC measurement signal to a measurement device;

a power supply circuit powered by the current received at the signal output for producing at least one non-ground DC voltage; and at least one DC voltage output connected to the power supply circuit for providing the transducer with the at least one DC voltage, the at least one DC voltage output being separate from the signal input.

2. The power supply of claim 1 wherein the transducer is a precision microphone with an attached pre-amplifier.

3. The power supply of claim 2 integrated into a microphone assembly comprising the precision microphone, the pre-amplifier, and the power supply.

4. The power supply of claim 1 further comprising a buffer amplifier connected between the signal input and the signal output for buffering the AC measurement signal and for continuously regulating the DC voltage level at the signal output to maintain the DC level within the operative range of the Dower supply circuit.

5. The power supply of claim 1 further comprising a shunt regulator connected to the signal output for continuously regulating a DC level of the signal output to maintain the DC level within the operative range of the power supply circuit.

6. The power supply of claim 1 wherein the signal input and the signal output form a first channel, the power supply comprising at least two channels, each channel having a signal input and a signal output.

7. The power supply of claim 1 wherein the at least one DC voltage produced by the power supply circuit comprises a DC polarization voltage and a pre-amplifier power voltage, the DC polarization voltage having a voltage level higher than a voltage level at the signal output.

8. A method of providing at least one DC voltage to a transducer, comprising:

receiving an AC signal from the transducer at a signal input of a power supply;

powering the power supply with an external constant current source applied at a signal output of the power supply;

generating the at least one DC voltage in the power supply, the at least one DC voltage comprising a polarization voltage having a voltage level higher than a voltage level at the signal output; and providing the at least one DC voltage to the transducer by driving at least one voltage output of the power supply with the at least one DC voltage.

9. The method of claim 8 for also buffering the AC signal from the transducer, the method further comprising:

buffering the AC signal received at the signal input of the power supply;

continuously regulating the DC level of the signal output to maintain the DC level within the operative range of the power supply circuit; and driving the signal output with the buffered AC signal.

10. The method of claim 8 wherein the at least one DC voltage comprises a polarization voltage and a pre-amplifier power voltage.

11. A power supply for transducers, comprising:

a first connector for attaching the power supply to a measurement instrument with two conductors, the first connector having a signal output and a ground;

a second connector for attaching the power supply to a transducer with more than two conductors, the second connector having at least a signal input, a ground, and a DC voltage output; and a power supply circuit electrically connected to the first and second connectors, the power supply circuit receiving a measurement signal from the transducer on the signal input and applying the measurement signal to the signal output;

the power supply circuit being powered by a current applied to the signal output by a constant current source external to the power supply, the power supply circuit generating a preamplifier power voltage and applying the voltage to the DC voltage output of the second connector.

12. The power supply of claim 11 wherein the second connector has a second DC voltage output, the power supply circuit further generating a polarization voltage and applying the polarization voltage to the second DC voltage output the polarization voltage having a voltage level higher than a voltage level at the signal output.

13. The power supply of claim 11 further comprising:

a buffer amplifier connected between the signal input and the signal output for buffering the measurement signal; and a shunt regulator connected to the signal output for continuously regulating a DC level of the signal output to maintain the DC level within the operative range of the power supply circuit.

14. The power supply of claim 11 further comprising:

an attenuator connected to the signal input for attenuating the measurement signal.

* * * * *